United States Patent [19]

Gailey

[11] Patent Number: 4,483,116

[45] Date of Patent: Nov. 20, 1984

[54] CEILING SYSTEM WITH CEILING CONVERSION STRIP

[75] Inventor: J. Lynn Gailey, Newton Falls, Ohio

[73] Assignee: Alcan Aluminum Corporation, N.Y.

[21] Appl. No.: 194,082

[22] Filed: Oct. 6, 1980

[51] Int. Cl.[3] ..... E04B 5/52

[52] U.S. Cl. ..... 52/484; 52/39; 52/507; 52/669

[58] Field of Search ..... 52/484, 482, 781, 473, 52/669, 664, 39, 78, 489, 222

[56] References Cited

U.S. PATENT DOCUMENTS

| | | | |
|---|---|---|---|
| 2,591,361 | 4/1952 | Knott . | |
| 2,994,113 | 8/1961 | Dail . | |
| 3,228,159 | 1/1966 | Vecchiarelli | 52/222 |
| 3,246,432 | 4/1966 | Young | 52/98 |
| 3,295,284 | 1/1967 | Tschiesche | 52/483 |
| 3,313,075 | 4/1967 | Buchmeier | 52/489 |
| 3,618,176 | 11/1971 | Barns | 24/84 |
| 3,678,641 | 7/1972 | Englund | 52/484 |
| 4,063,391 | 12/1977 | Balinski | 52/496 |
| 4,073,458 | 2/1978 | Sease | 52/39 |
| 4,245,466 | 1/1981 | Judkins | 52/484 |
| 4,270,327 | 6/1981 | Leeuwen | 52/484 |

FOREIGN PATENT DOCUMENTS

| | | | |
|---|---|---|---|
| 1123293 | 9/1956 | France | 52/484 |

*Primary Examiner*—Henry E. Raduazo

*Attorney, Agent, or Firm*—Maky, Renner, Otto & Boisselle

[57] ABSTRACT

An elongated ceiling conversion strip 28 comprising an elongated flat central web 32, an upper flange portion 34 extending upwardly from the inner longitudinal edge of web 32 and an array of spaced mounting brackets 42 depending from said web, each of said mounting brackets comprising a lower flange portion 44 extending downwardly from said web and a pair of mounting flanges 46 and 48 extending longitudinally from said lower flange portion, each of said mounting flanges extending in opposite directions from each other. A ceiling assembly for utilizing conversion strip 28 comprising a drop-in ceiling assembly 10 and a linear ceiling assembly 14 is also disclosed.

4 Claims, 5 Drawing Figures

CEILING SYSTEM WITH CEILING CONVERSION STRIP

TECHNICAL FIELD

This invention relates to suspended ceilings, and in particular to suspended celings of an array of parallel elongated ceiling panels. Specifically, this invention is directed to a ceiling conversion strip and ceiling assemblies employing such strips.

BACKGROUND OF THE INVENTION

Suspended ceilings are widely used in interior construction for aesthetic purposes and other reasons. A typical suspended ceiling comprises an assembly of panels that are spaced below the true or structural ceiling of a room and are carried by horizontal stringers or like members which are themselves suspended from the true ceiling. A common design for such suspended ceilings employs a planar grid of inverted tee shaped members and an array of drop-in ceiling panels. Such grids generally include an array of parallel spaced main runs suspended from a superjacent structure and an array of parallel spaced cross runs connected to and supported at their ends by the main runs. Drop-in ceiling panels are positioned in the rectangular openings defined by the grid and supported by flanges of the inverted tee shaped members surrounding each opening. For convenience these ceilings are herein referred to as drop-in ceilings. Ceiling systems employing such designs are disclosed, for example, in U.S. Pat. Nos. 2,994,113; 3,246,432; 4,063,391 and 4,086,480.

A more recent design that has become popular with architects and the like constitutes suspended ceilings employing relatively narrow elongated panels that are often formed of aluminium or similar materials and extend horizontally in parallel relation to each other. These panels are suspended by parallel spaced elongated superjacent stringers which are themselves suspended from the true ceiling. Such ceilings have an attractive decorative appearance and under various advantageous conditions may also serve to conceal structures such as lights, sprinklers, speakers, ventilation equipment, etc., mounted in the space or plenum above the suspended ceiling, while permitting the passage of light, water, sound or air between the panels. For convenience these ceilings are herein referred to as linear ceilings (because of the linear orientation of the panel major surface). Ceiling systems employing such designs are disclosed, for example, in U.S. Pat. Nos. 3,295,284; 3,313,075 and 3,678,641.

In the reconstruction markets and do-it yourself markets, it is often desirable to convert existing drip-in ceilings to linear ceilings. To provide a wide acceptance of linear systems by such markets, it is necessary to provide a readily acceptable support arrangement for converting existing drop-in ceilings to linear ceilings. Desirable criteria for such an arrangement include low cost, ease of installation, and variablility of design, as well as stability of support for the narrow elongated panels of the linear ceiling. Various clip designs have been proposed but are inappropriate for facilitatingly converting drop-in ceilings to linear ceilings. U.S. Pat. No. 3,618,176 discloses a hanger clip suspended from a tee bar, but does not provide for facilitating installation and the achievement of a proper positioning and alignment of successive courses of ceiling panels.

SUMMARY OF THE INVENTION

Ceiling systems that include the elongated ceiling conversion strip of the type hereinafter described can be positioned, aligned and mounted on existing drop-in ceiling assemblies with no special tools and relatively little skill. Ceiling systems embodying the present invention are particularly suitable for installation by "do-it-yourself" homeowners without experience or special equipment as well as other relatively unskilled workers.

Broadly stated, the invention contemplates the provision of an elongated ceiling conversion strip comprising an elongated central web, an upper flange portion extending upwardly from the inner longitudinal edge of said web, and an array of spaced mounting brackets depending from said web, each of said mounting brackets comprising a lower flange portion extending downwardly from said web and a pair of mounting flanges extending longitudinally from said lower flange portion, each of said mounting flanges extending in opposite directions from each other. Advantageously, the upper flange portion of said conversion strip is a continuous member extending over the entire length of said web. In a preferred embodiment, each of the mounting brackets of said conversion strip depend from an elongated inwardly opening channel that extends longitudinally beneath said web. In a particularly advantageous embodiment, said channel is formed by said web and a flat elongated strip depending from the outer longitudinal edge of said web, said strip being disposed below said web in spaced substantially parallel relationship to said web.

Further, the invention contemplates the provision of a ceiling assembly comprising: a drop-in ceiling structure comprising a plurality of horizontally elongated longitudinal inverted tee members suspended from superjacent structure and a plurality of rectangular drop-in ceiling panels supported by said tee members; and a linear ceiling structure disposed beneath and depending from said drop-in ceiling structure, said linear ceiling structure comprising a plurality of horizontally extending longitudinal ceiling conversion strips mounted on and extending beneath said tee members and an array of parallel elongated panels depending from and extending horizontally transversely of and beneath said tee members, each of said conversion strips having a horizontally extending longitudinal flat central web, an upper flange portion extending upwardly from the inner longitudinal edge of said web and an array of spaced mounting brackets depending from said web, each of said mounting brackets comprising a horizontally extending longitudinal lower flange portion extending downwardly from said web and a pair of mounting flanges extending horizontally and longitudinally from said lower flange portion, each of said mounting flanges extending in opposite directions from each other, and each of said elongated panels of said linear ceiling structure having inturned longitudinal edges for engaging mounting flanges of at least two of said conversion strips. Advantageously, the upper flange portion of each of the conversion strips utilized in the foregoing ceiling assembly is disposed between the vertical web portion of one of said inverted tee members and an edge of drop-in ceiling panel. In a preferred embodiment, the mounting brackets of each conversion strip utilized in the foregoing ceiling system depend from an elongated inwardly opening channel member that depends from and extends longitudinally beneath the web of said conversion strip, said channel member receiving at least part of the horizontally extending lower flange portion of inverted tee member.

It will be understood that terms such as "inner" or "inwardly" and "outer" or "outwardly" herein designate directions respectively toward and away from an inverted tee member relative to the position of a conversion strip mounted on said tee member, and that these terms, as well as terms such as "upper" or "top" and "lower" or "bottom", are used with reference to the orientation of such conversion strip when mounted on such inverted tee member with the long dimension of conversion strip extending horizontally.

DETAILD DESCRIPTION OF THE PREFERRED EMBODIMENT

Figure 1:
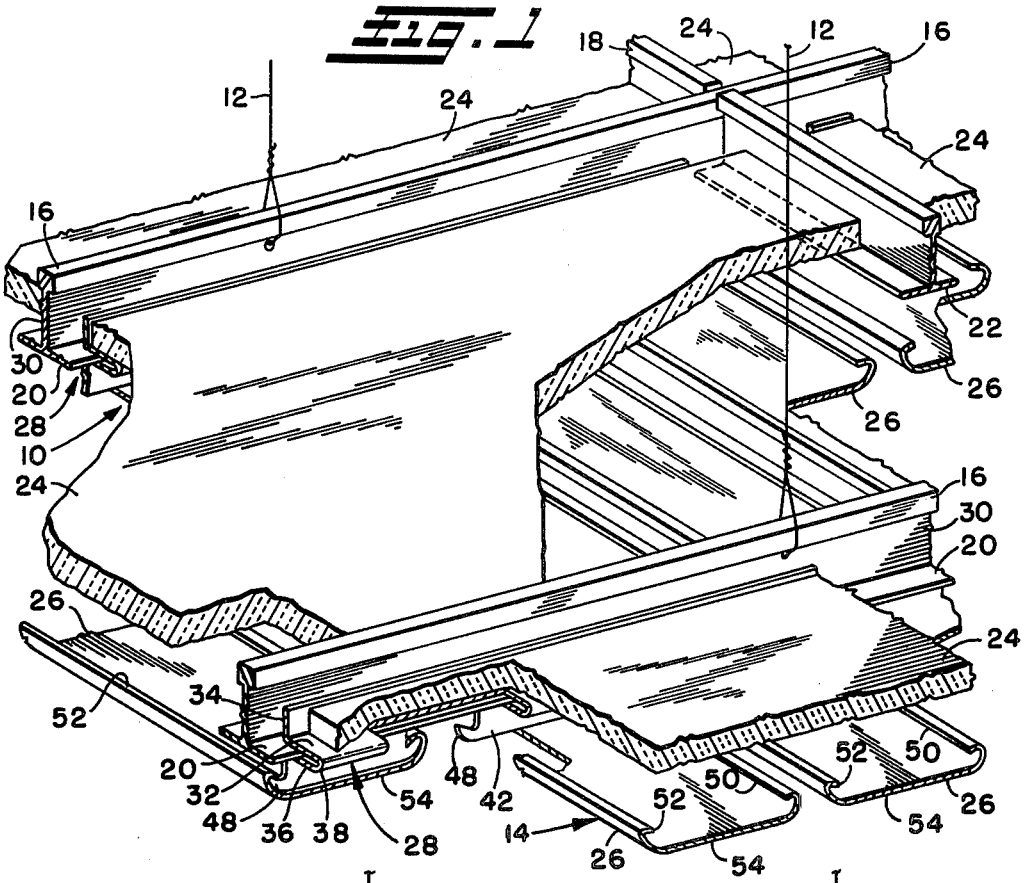
FIG. 1 is a fragmentary partially cut away perspective view of a ceiling system embodying the present invention in a particular form.
Figure 2:
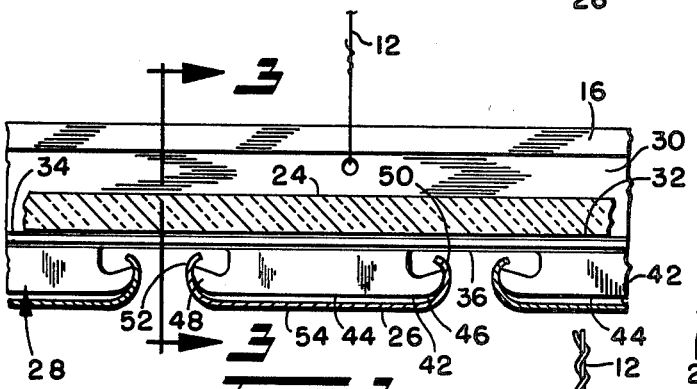
FIG. 2 is a slightly enlarged side elevational cross-sectional view of the ceiling system illustrated in FIG. 1.
Figure 3:
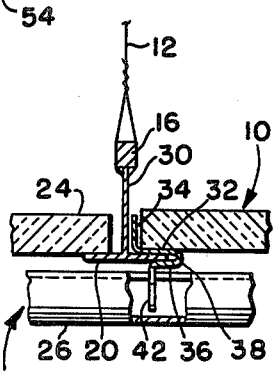
FIG. 3 is a cross-sectional partially cut away elevational view taken along line 3—3 of FIG. 2.
Figure 5:
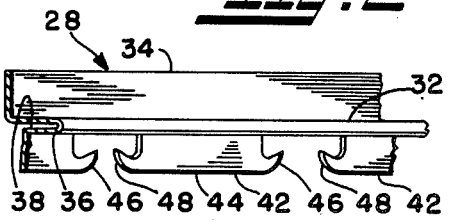
FIG. 5 is a fragmentary perspective view of a conversion strip embodying the present invention in a particular form.

The ceiling system of the present invention, in its illustrated embodiment, comprises a drop-in ceiling system indicated generally by the reference numeral 10 suspended by wires 12 from a superjacent building structure (not shown), and a linear ceiling system indicated generally by the reference numeral 14 that depends from and extends beneath the drop-in ceiling system 10, all as hereinafter further explained.

The drop-in ceiling system 10 is formed of a plurality of elongated inverted tee members arranged in an array of main runs 16 and an array of cross runs 18. The main runs 16 are suspended from the builiding structure by wires 12 and are assembled from a plurality of end connected elongated inverted tee members. The cross runs 18 are formed of separate elongated inverted tee members which are connected at their ends by the main runs 16 and are supported by and extend between the main runs 16. The main runs and cross runs cooperate to define a reticulated grid or array of rectangular panel openings bounded by horizontally extending flange portions 20 and 22 of inverted tee members 16 and 18, respectively. Flange portions 20 and 22 provide support for rectangular drop-in ceiling panels 24. Panels 24 are flat, rectangular, semi-rigid, members with flat, parallel major upper and lower surfaces. Panels 24 are cut to accommodate the rectangular openings defined by tee members 16 and 18 and are constituted of fiberboard, for example, or any other material that is semi-rigid in the described configuration, many such materials being known in the art. Ceiling system 10 may include, for example, lighting fixtures, sprinklers, speakers, ventilation equipment, etc., integrated with ceiling system 10 or installed above or below it. Such equipment and the use thereof with drop-in ceiling assemblies is well known to those of ordinary skill in the art and, consequently, need not be further described herein.

The linear ceiling system 14 is formed of an array of relatively narrow, elongated parallel spaced ceiling panels 26 extending horizontally transversely of and beneath elongated inverted tee members 16. Panels 26 are supported by a plurality of horizontally extending longitudinal ceiling conversion strips which are indicated generally by the reference numeral 28 and are mounted on and extend beneath either tee members 16 or tee members 18. Each of the inverted tee members 16 and 18 comprise upwardly extending horizontally elongated longitudinal central web portions 30 and 31, and horizontally elongated longitudinal lower flange portions 20 and 22 depending from and extending horizontally outwardly from webs 30 and 31, respectively. Flange portions 20 and 22 are adapted for supporting drop-in panel members 24. Ceiling conversion strip 28 is adapted for mounting on either inverted tee member 16 and 18 with drop-in panel 24 overlying conversion strip 28, as hereinafter further explained.

Conversion strip 28 is a unitary, horizontally elongated member that is self-sustaining in shape and preferably constituted of a material such as, for example, aluminum or steel. Conversion strip 28 is supplied in convenient lengths such as, for example, two or four foot lengths, but can be longer or shorter and under various advantageous conditions cut at the installation site by simple measuring and sawing operations. The appropriate length of conversion strip 28 is selected for manufacturing purposes with regard to substantially facilitating installation of the conversion strip, and enabling convenient transport and handling prior to use. Two-foot lengths are particularly advantageous since most conventional drop-in ceiling systems employ grids with two-by-four foot rectangular panel openings. Under such circumstances, two-foot lengths are a convenient multiple, can be used to extend longitudinally in the direction of either the main runs or the cross runs of the system, and can be facilitatingly installed without any cutting or measuring. More particularly, conversion strip 28 comprises a horizontally extending longitudinal flat central web 32 and a horizontally extending longitudinal upper flange portion 34 formed integrally with and extending upwardly from the inner longitudinal edge of web 32 at substantially a right angle to web 32. Thus the web 32 and the flange 34 form first and second legs, respectively, of an L-shaped beam. Depending from the outer longitudinal edge of web 32 is a horizontally extending longitudinal flat rectangular strip 36 which is formed integrally with and is disposed in spaced substantially parallel relationship with web 32. Web 32 and strip 36 together form horizontally extending longitudinal inwardly opening channel or U-shaped slot 38 which is adapted for receiving flange 20 with the underside of web 32 overlying flange 20, and the upper surface of strip 36 extending beneath flange 20. Depending from the inner longitudinal end of strip 36 are a plurality of vertically extending longitudinal substantially equally spaced mounting brackets 42. Each mounting bracket 42 comprises a downwardly extending longitudinal lower flange portion 44 and a pair of longitudinal mounting flanges 46 and 48 extending horizontally from the sides of lower flange 44 in opposite directions of each other.

Conversion strip 28 is preferably made from a flat elongated rectangular sheet of metal such as, for example, aluminum or steel, preferably by first punching out portions along one longitudinal edge to form mounting brackets 42. The upper flange portion 34 is formed by bending one side of the sheet along its full length upwardly to an angle of about 90°. The channel 38 is formed by bending the other side of the sheet first downwardly and then inwardly along the full length of the sheet until strip 36 is substantially parallel with the sheet. The mounting brackets 42 are bent downwardly to an angle of about 90° with strip 36. The necessary equipment, procedures and techniques for making units such as strip 28 are well known to those of ordinary skill in the art and, consequently, need not further be described herein.

Figure 4:
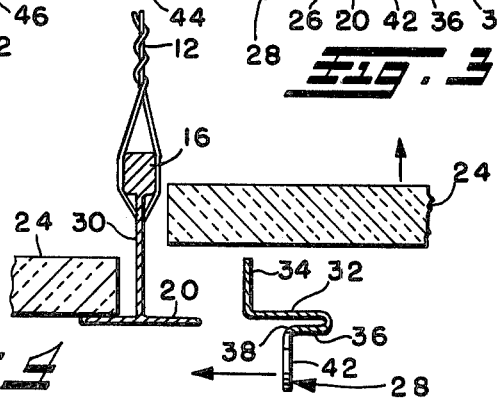
FIG. 4 is a slightly enlarged exploded cross-sectional view similar to the view illustrated in FIG. 3 with the exception that the drop-in ceiling panel and conversion strip are displaced from the inverted tee support member and the ceiling panel of the linear ceiling structure is not shown.

As used in constructing a ceiling, the conversion strip 28 is quickly and easily attached to existing ceiling system 10 by pushing drop-in ceiling panel 24 upwardly (FIG. 4), sliding conversion strip 28 onto either inverted tee member 16 or 18 with upper flange portion 34 adjacent to web 30 or 31, web 32 overlying flange 20 or 22 and flange 20 or 22 being received by channel 38. Once the conversion strip 28 is installed on tee member 16 or 18, drop-in ceiling panel 24 is placed back down to overlie conversion strip 28. Additional conversion strips 28 are mounted over the entire length and breadth of the ceiling 10 as required with the respective mounting brackets of the strips that are spaced parallel to each other being horizontally aligned, i.e., with the first mounting brackets of all the conversion strips lying in a common horizontal line, the second mounting brackets of all the conversion strips lying in a second common horizontal line, and so forth. Conversion strips 28 are placed end-to-end along the main runs or cross runs of ceiling 10 depending upon the desired orientation of the panels 26, it being understood that the common horizontal line of such strips are interrupted by transversely extending cross runs or main runs, as the case may be. The number of conversion strips 28 required and the transverse horizontal spacing between such strips is dependent on the length of panels 26. At least two conversion strips are required to support each panel 26, one of the strips being located at or near one end of the panel and the other being located at or near other end. In instances wherein the panels have extended lengths such as, for example, thirty feet or more intermediately spaced conversion strips may have to be used to avoid sagging. The combination of channel member 38 receiving flange 20 and drop-in ceiling panel 24 overlying web 32 and abutting or at least being disposed adjacent to upper flange 34 provides a stable and secure mounting arrangement for ceiling assembly 14 without the necessity of employing any clips, tabs or other fastening devices.

Each ceiling panel 26 is an elongated rectangular thin sheet article, that is self-sustaining in shape. The major extent of each panel 26 is a central web 54; both of its longitudinal edges are bent inwardly to form inturned longitudinal edges 50 and 52 which are adapted for engaging flanges 46 and 48, respectively. Panels 26 can be supplied in convenient lengths such as, for example, four, eight or twelve feet, or can be specially made to accommodate specific installations. Panels 26 are constituted of a metal such as, for example, aluminium or steel, or formed from a suitable plastic such as vinyl, and are resiliently flexible for snap-fitting engagement over mounting bracket 42. For purposes of protection and appearance, panels 26 may be painted or otherwise coated on all surfaces. Each ceiling panel 26 is mounted on at least two horizontally aligned mounting brackets 42 by simply pushing panel 26 upwardly; the longitudinal edges 50 and 52 slide outwardly and upwardly over flanges 46 and 48 until such edges reach the top of such flanges wherein they snap-fittingly slide inwardly to engage flanges 46 and 48, respectively. It is to be understood that the actual shape of flanges 46 and 48 are dependent upon the cross-sectional shape of panels 26 and, in particular, on the shapes of inturned edges and 52. Similarly, the longitudinal length of mounting brackets 42 is dependent upon the width of panels 26. The vertical extent of mounting brackets 42 is dependent upon the desired gap between ceiling system 10 and ceiling system 14. Ceiling system 14 is well adapted to structural modification which may be desirable. For example, the ceiling panels 26 of the illustrated embodiment are just wide enough to extend between adjacent mounting flanges 46 and 48. Instead of so limiting the width of the panels, such panels may be made wider so as to extend, for example, between alternate mounting flanges instead of between adjacent mounting flanges. Additionally, elongated rectangular longitudinal strips can be attached to one or both longitudinal edges of panel 26 to cover the gaps between adjacent mounted panels. Additionally, the central web 54 of panels 26 can include any number of patterns or deformations such as, for example, longitudinal bends or creases or transverse arcuate patterns, to provide a desired aesthetic appeal.

By this simple snap-fitting operation, all of the successive courses of panels 26 are rapidly mounted, each securely held along both longitudinal edges, and cooperatively present a ceiling assembly with a desired aesthetic appeal. No special tools or skills are needed for the installation of strips 28 or panels 26, because proper alignment of the ceiling panels is assured through the sizing of the conversion strip 28 and formation of the mounting brackets 42 by the manufacture. As will be appreciated, positioning and mounting the relatively small number of conversion strips on the existing ceiling structure is much easier than positioning and mounting the far larger number of individual mounting brackets. Since the conversion strips are not fixedly attached by clamps, tabs, or the like, the ceiling system 14, or parts thereof, can be removed with relative ease if necessary for repair or replacement. In addition, manufacture of the components of ceiling system 14, including the conversion strip 28, is relatively facile and inexpensive.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. In combination, a drop-in ceiling system formed of an interconnected reticulated grid of inverted T-beams supporting a plurality of rectangular drop-in ceiling panels, a linear system formed of elongated strip elements, and a conversion strip for connecting said linear ceiling system to said drop-in ceiling system, said conversion strip comprising an axially extending L-beam a first leg of which engages the top of a horizontal portion of a T-beam and a second leg of which extends upwardly for positioning between the vertical web portion of the T-beam and a ceiling panel, a flat elongated member depending from an edge portion of said first leg of said L-beam and extending substantially parallel therto, said first leg and said member defining a U-shaped slot for receiving a horizontal flange of an inverted T-beam, and a bracket extending downward from said member and having a pair of oppositely extending flange means for engaging a strip element.

2. The conversion strip of claim 1 wherein said first and second legs are at a substantially right angle to each other.

3. The conversion strip of claim 1 wherein said second leg of said L-beam is continuous along the entire length of said first leg.

4. The conversion strip of claim 1 including a plurality of said mounting brackets evenly spaced along the axial extent of said L-beam.

* * * * *